US007318377B2

(12) United States Patent
Espy et al.

(10) Patent No.: US 7,318,377 B2
(45) Date of Patent: Jan. 15, 2008

(54) APPARATUS AND METHOD FOR INTEGRATED SCREEN PRINTING AND LASER TREATMENT OF MATERIALS

(75) Inventors: Jon Espy, Lenexa, KS (US); Ray Althaus, Lenexa, KS (US)

(73) Assignee: GFSI, Inc., Lenexa, KS (US)

( * ) Notice: Subject to any disclaimer, the term of this patent is extended or adjusted under 35 U.S.C. 154(b) by 213 days.

(21) Appl. No.: 11/102,115

(22) Filed: Apr. 7, 2005

(65) Prior Publication Data

US 2006/0225587 A1 Oct. 12, 2006

(51) Int. Cl.
*B41F 15/12* (2006.01)

(52) U.S. Cl. ..... 101/129; 101/126; 101/484

(58) Field of Classification Search ..... 101/114, 101/115, 126, 129, 474, 484
See application file for complete search history.

(56) References Cited

U.S. PATENT DOCUMENTS 5,567,207 A 10/1996 Lockman et al.
5,916,461 A 6/1999 Costin et al.
5,990,444 A 11/1999 Costin
6,002,099 A 12/1999 Martin et al.
6,140,602 A 10/2000 Costin
6,252,196 B1 6/2001 Costin et al.
6,315,202 B2 11/2001 Costin et al.
6,495,237 B1 12/2002 Costin
6,528,758 B2 3/2003 Shaffer
6,576,862 B1 6/2003 Costin et al.
6,616,710 B1 9/2003 Costin et al.
2005/0155500 A1* 7/2005 Latos et al. ..... 101/126

* cited by examiner

*Primary Examiner*—Leslie J. Evanisko
(74) *Attorney, Agent, or Firm*—Bryan Cave LLP

(57) ABSTRACT

An apparatus and method for treating material using a screen print machine having multiple stations with a printing head for screen printing ink installed at a first station and a laser device for producing graphics installed at a second station. A PLC is connected to the laser device and the second station of the screen print machine, and is programmed to receive control signals for a printing head at the second station and operational status signals from the laser. Based upon the received signals the PLC sends signals which mimic status indications of a printing head located at the second station to the screen print machine based upon the operational status of the laser. The PLC also sends signals to control the laser in synchronization with the printing head based upon the received control signals for a printing head at the second station.

4 Claims, 7 Drawing Sheets

FIG. 4
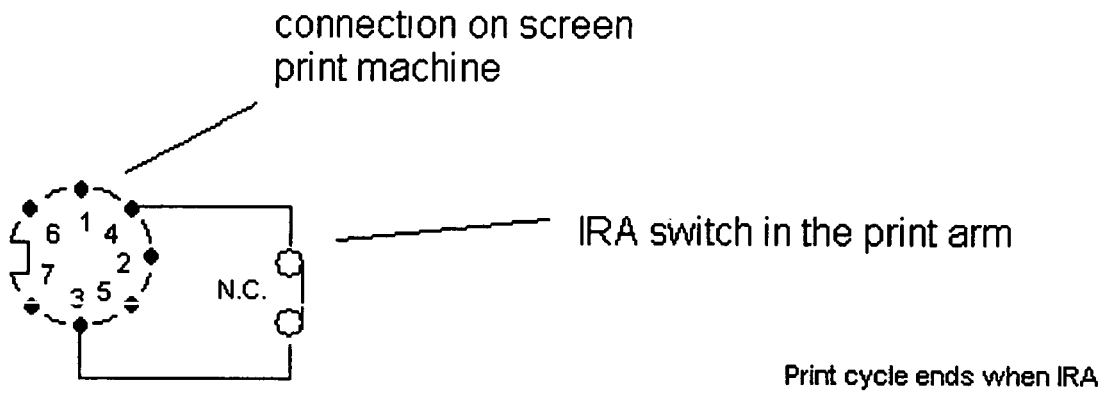
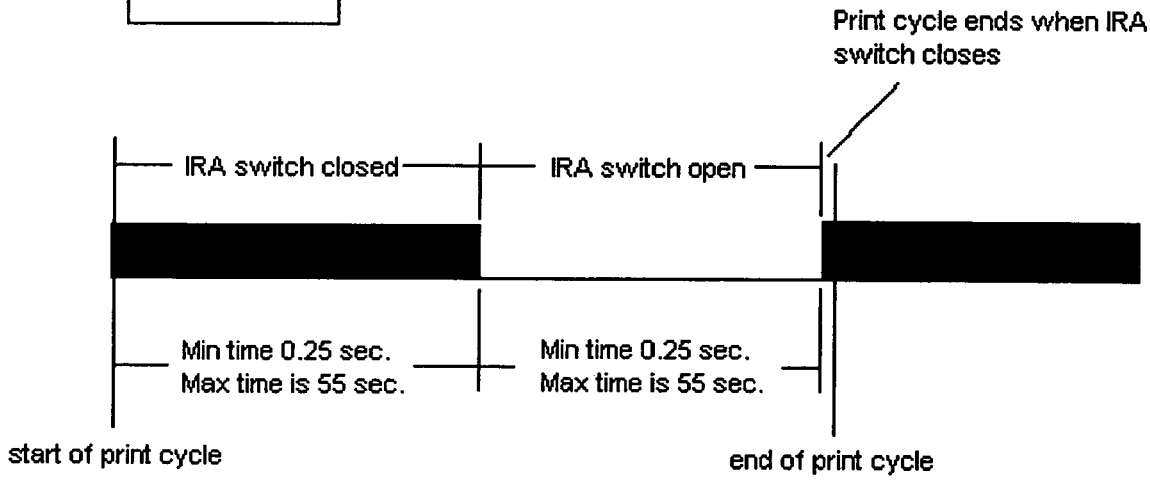
FIG. 5

APPARATUS AND METHOD FOR INTEGRATED SCREEN PRINTING AND LASER TREATMENT OF MATERIALS

FIELD OF INVENTION

The present invention relates, in general, to screen printing and laser treatment of materials, and more particularly, to integration of laser equipment with screen print machines for screen printing and laser treatment of fabric materials.

BACKGROUND OF THE INVENTION

Screen printing is an established way of creating designs on various substrates, where a stencil is formed by a screen, the screen is used to ink a substrate, and the substrate is then allowed to dry. Early versions of screen printing used silk stretched over a wooden frame to form the screen. A design was created by painting the screen with a greasy medium. The pores of the silk were then closed using a suitable gum. The pores of the silk in the areas covered by the greasy medium were not closed because the greasy medium rejected the gum. Thereafter, the greasy medium was washed away with a solvent, such as turpentine, if paint was used as the greasy medium, resulting in the corresponding areas becoming pervious to ink. The screen was then placed on the surface of the substrate to be decorated and ink was applied through the screen to the surface using a rubber squeegee. The ink soaked through the pervious areas of the silk and was imprinted on the substrate.

More recent versions of screen printing use fine mesh screen materials rather than silk. The chosen screen material is coated with a photographic emulsion. The photographic emulsion is exposed to a suitable source of light, with the image to be reproduced being located between the light and the emulsion. The light causes the emulsion to harden except in areas where the image is located. Thereafter, the screen is washed to remove the emulsion from the areas where it has not been hardened by the light, i.e., the image areas. The screen is then ready to be used as a stencil to print a design on a substrate.

A print screen including a stencil is mounted to be set down onto the material portion to be printed. The stencil is of a design, letter, number, etc., that is to be printed on the material when ink is moved across the screen by use of a squeegee that forces the ink through small pores in the stencil. As is known in the art, an automated screen print press is a piece of equipment that can mechanically apply ink through a silk screen onto a substrate, such as fabric. An automated screen print press provides mechanical material handling for processing material portions through a series of print heads, each of which performs a different screen print operation. Material portions are supported by a series of rotating pallets which sequentially position the material portions at the work stations. Then at one or more of the work stations, print heads installed on support arms are lower down to the material potions on the pallets.

The screen print press loads, unloads fabric portions, applies ink, and dries the applied ink in an assembly line fashion. The finished portion returns to the original station where loaded, so that it can be unloaded. The pallet is then reloaded with another fabric segment to be printed. An automated screen print press may comprise multiple heads from which separate colors are screen printed.

Laser equipment has also been used to scribe graphics on materials. In this process, a laser beam contacts a material and alters the physical and/or chemical properties of the material to scribe a graphic.

SUMMARY OF THE INVENTION

The present invention safely and efficiently provides for integrated screen printing and laser treatment of materials, such as fabric garments, by integrating laser etching equipment with an automated screen print press. The present invention provides an interface between a laser and a multiple pallet automated screen print press to continuously process material portions through a desired series of screen print stations and a laser. The interface initiates operation of the laser only when (1) a pallet of the press is properly positioned within the work zone of the laser and (2) when the laser safety enclosure is in position to prevent exposure of human operators or foreign materials to the laser output. A printing head for screen printing ink is installed at one or more stations and a laser device for producing graphics is installed at another station. A PLC is connected to the laser device and to the screen print machine at the station where the laser is installed. The PLC is programmed to receive control signals from the automated screen print press intended for a printing head at the station where the laser is installed and operational status signals from the laser. The PLC sends signals to the screen print machine which mimic status indications of a printing head based upon the operational status of the laser. The PLC also sends signals to control the laser in synchronization with the printing head based upon the received control signals for a printing head at the station where the laser is installed.

BRIEF DESCRIPTION OF THE DRAWINGS

FIG. 4 illustrates the pins of a connection on the screen print machine that receive sensor indications from the print arm.

FIG. 5 is a diagram of the print cycle timing.

The drawings are provided for illustrative purposes only and should not be used to unduly limit the scope of the invention.

DETAILED DESCRIPTION OF THE PREFERRED EMBODIMENT

It is to be understood by one of ordinary skill in the art that the present discussion is a description of exemplary embodiments only, and is not intended as limiting the broader aspects of the present invention, which broader aspects are embodied in the exemplary constructions.

Figure 1:
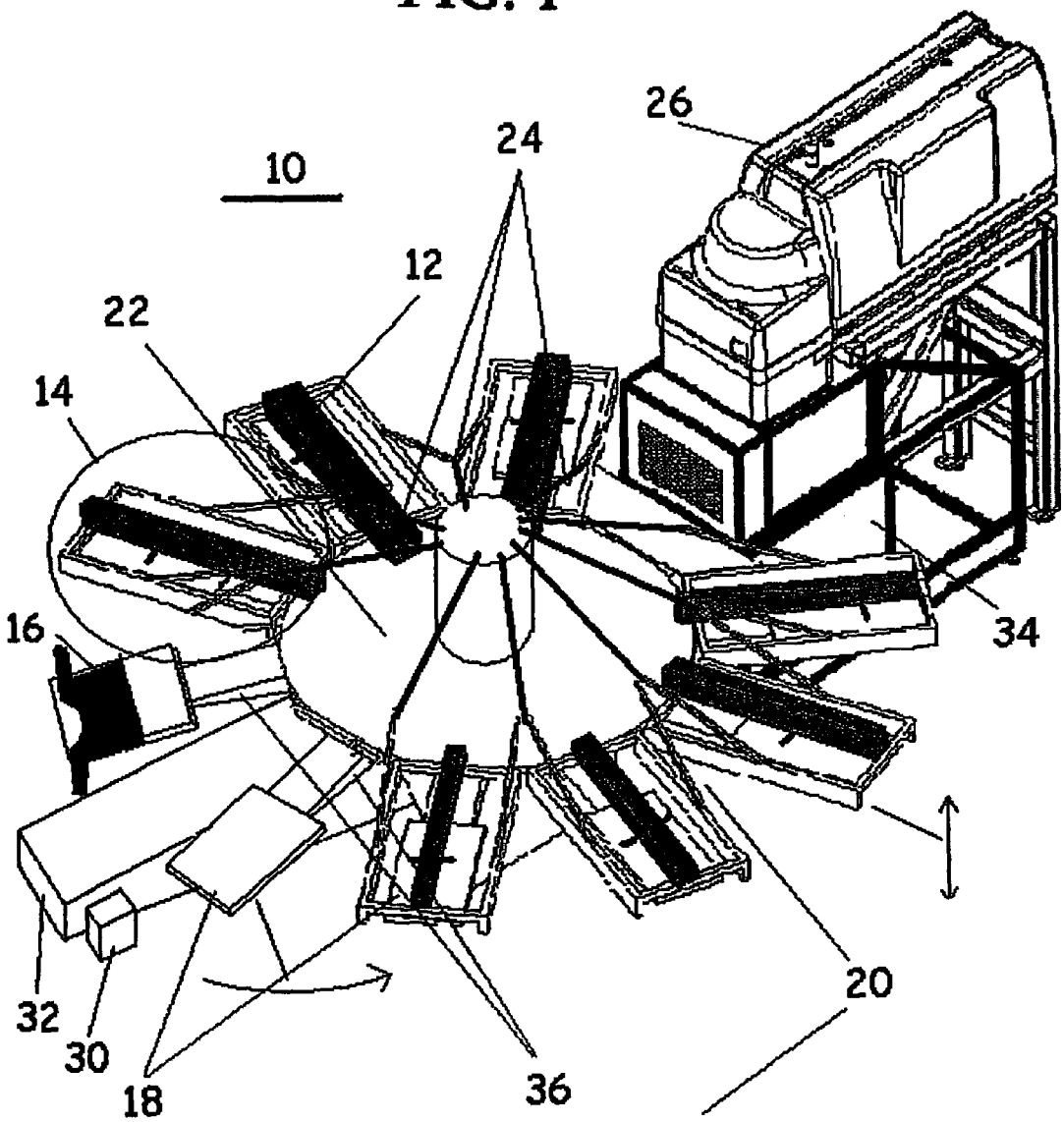
FIG. 1 is an illustration of a screen print machine with a laser device installed at one of the print head locations, exemplifying a first preferred embodiment of the present invention.

FIG. 1 is an illustration of a typical screen print machine with a laser device installed at one of the print head locations, exemplifying a first preferred embodiment of the present invention. As illustrated in FIG. 1, a screen print machine 10 comprises a carousel 20, with multiple print platforms (pallets) 18 which rotate to the successive print stations 14. At the center of the carousel is a center hub 22, which engages a plurality of support arms 24. At some or all of the work stations 14, print heads 12 are suspended above the pallets by the print station 14. In operation, the print heads 12 installed on the print stations 14 are simultaneously lowered down to engage the material portions 16 on the pallets 18 at one of the work stations which does not have a print head installed. A screen print press may typically have from 6 to 14 work stations. Material portions 16 are loaded onto a pallet 18 at one of the work stations 14, which then advance under automatic or manual control, such as when a foot pedal is engaged by an operator.

As illustrated in FIG. 1, each work station 14 on the press 10 can perform multiple functions. For example, if a print head 12 is installed at the workstation, it can be used to apply ink. A work station can also be used to dry a previous ink application. Alternatively a work station may selectively remain unused, if the art being printed on the material does not call for the use of printing heads at all available work stations. After the material portion 16 is loaded onto the pallet 18, the carousel advances one station in a counter-clockwise fashion. When the pallet 18 reaches a work station 14 with a silk screen print head 12 installed, the center hub 22 is mechanically lowered until the print head 12 is proximate the pallet 18. Next, within the silk screen print head 12, a squeegee, which is driven by a pneumatic cylinder inside the print head 12, moves along the top of the screen, applying ink. When the inking is complete, the center hub 22 is raised and the carousel 20 advances one location. This process is repeated until the first material portion returns to the loading station, where it is removed and placed on a conveyor belt for further processing. The pallets 18 are typically constructed from honeycombed aluminum and are locked onto the pallet arm 36. Commercial screen print machines, such as the Synchroprint 3000 and Synchroprint 2000 press, use electrically powered drive systems, such as an AC servo-drive indexer. The print head operations may be powered by pneumatics (print stroke, flood stroke, up/down of the squeegee, etc.) or a DC electric-drive motor for the squeegee and flood strokes.

Laser

In the preferred embodiment of the present invention, a laser device 26 is installed at one or more of the work stations on the screen print machine 10. The laser 26 is preferably a diffusion-cooled (slab) CO2 laser. These lasers are able to produce high-energy short duration pulses that can produce clean high-density perforations in the fabric material.

Laser Control Module

The laser 26 includes a control module 28, which employs software to control the laser and beam manipulation head. The control software for the laser can be written in a Windows NT environment, using tool paths from either .dxf or .eps file formats. Digital converting allows part registration enables the cutting path to be oriented in x, y, and theta in relation to a part feature or print fiducials. Critical dimensions can be measured in-process and fed back from the laser control for SPC and cpk analysis.

Figure 2:
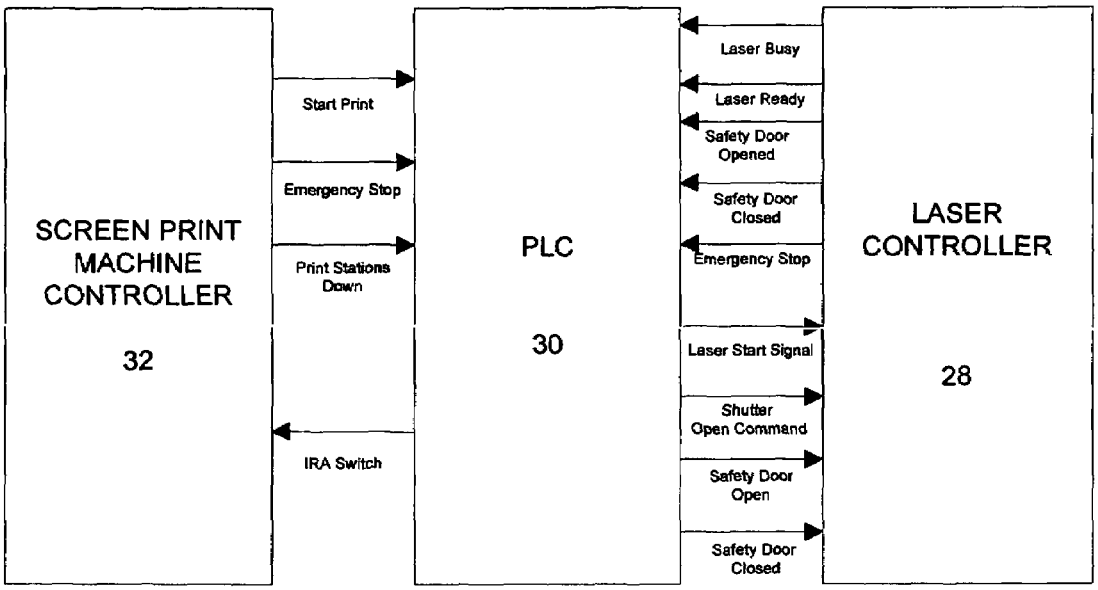
FIG. 2 is a schematic illustration of the signal inputs and outputs between a screen print machine controller, a programmable logic controller, and a controller for a laser device controller installed at one of the print head locations, exemplifying a first preferred embodiment of the present invention.

In the present invention, the laser 26 operates in place of a screen print station 14 through the use of a programmable logic controller (PLC) 30. The PLC interfaces with the screen print machine through a pin connection at one of the work stations 14 where the laser 26 is located, instead of a print head 12. FIG. 2 is a schematic illustration of the signal inputs and outputs between a screen print machine controller 32, a PLC 30, and a controller 28 for a laser device 26 installed at one of the work stations 14 where a print head 12 has been removed, exemplifying a first preferred embodiment of the present invention. As illustrated in FIG. 2, the screen print machine controller 32 sends a start signal for the print stroke, and monitors operational status of the print head by receiving indications from the IRA proximity switch in the print arm. The screen print machine controller 32 also sends a stop signal, when all operational parameters are not met for the screen print machine. This prevents operation of a print head under improper circumstances, such as, when the pallets on the carousel are not in proper position. The screen print machine controller 32 also sends a signal which indicates that the prints heads 12 of the screen print machine are in the down position, such that the print heads are properly positioned upon the pallets at the work stations for printing operations to commence.

As illustrated in FIG. 2, in the present invention, the signals traditionally sent by screen print machine controller 32 to the print head 12 are instead sent to the PLC 30. Also, as illustrated in FIG. 2, the PLC 30 receives input signals from the laser controller 28, processes them and converts them to signals which are input to the screen press controller 32 to simulate the operation of a print head, to allow the laser 26 to operate as required to treat the fabric portion in sequence with the print stations and to allow the rest of the screen print machine to operate normally. Based upon status signals received from the laser controller 28 indicative of the operational status of the laser 26, the PLC 30 sends signals to the screen print machine controller 32 which mimic status indications of a print head located at the work station 14 where the laser 26 is installed.

As shown in FIG. 2, the PLC also receives indications from the laser controller 28 concerning the laser's operational status, including a busy signal from the laser controller, which indicates the laser 26 is operating, a ready signal, which indicating the laser is prepared to operate upon receipt of a start signal, and proximity switch indications, which signal that the safety doors are in the open or closed positions. The PLC 30 also provides control signals to the laser control module 28 to control the operation of the laser in synchronization with the print heads 12 at the other work stations 14 based upon the control signals received from the screen print machine controller 32 for a print head located at the laser work station. As shown in FIG. 2, the PLC communicates with the laser controller 28 by sending a laser start signal, shutter open ("latch") and close ("unlatch") commands, and doors open and close commands. The PLC 30 thus provides control signals to the laser control module 28 to:

close the safety doors.

open the shutter on the laser beam.

provide a start process signal.

close the shutter on the laser beam.

open the safety doors.

The PLC 30 receives and processes signals from the laser control module 28, including:

a "ready" signal indicating that the laser is prepared for operating on the material portion.

a "busy" signal indicating that the laser is operating on the material portion.

proximity switch indications, which signal that the safety doors and safety guards are in the open or closed positions Additionally, when the screen print machine is put into (emergency stop) ("E-stop") mode, E-stop mode is also transferred to the Laser machine via the PLC. Similarly, if the laser machine is put into an E-stop mode, E-stop mode is also transferred to the Screen Print machine.

Communication between the screen print machine and the PLC is accomplished with relays to preclude interference between the separate and independent power supplies. Communication between the laser machine and the PLC is accomplished with a method known as sinking and sourcing using a single power supply.

Programmable Logic Controller

The PLC 30 is a microprocessor based device with either modular or integral input/output circuitry that monitors the status of field connected "sensor" inputs and controls the attached output "actuators" (motor starters, solenoids, pilot lights/displays, speed drives, valves, etc.) according to a user-created, logic program stored in the microprocessor's battery-backed RAM memory. A suitable model of PLC for a preferred embodiment of the present invention is the Allen-Bradley MicroLogix 1000 controller. As is known and appreciated in the art, other types of data processors with digital processing capability may be used to perform the function of the PLC, such as a PC or laptop computer.

Figure 3:
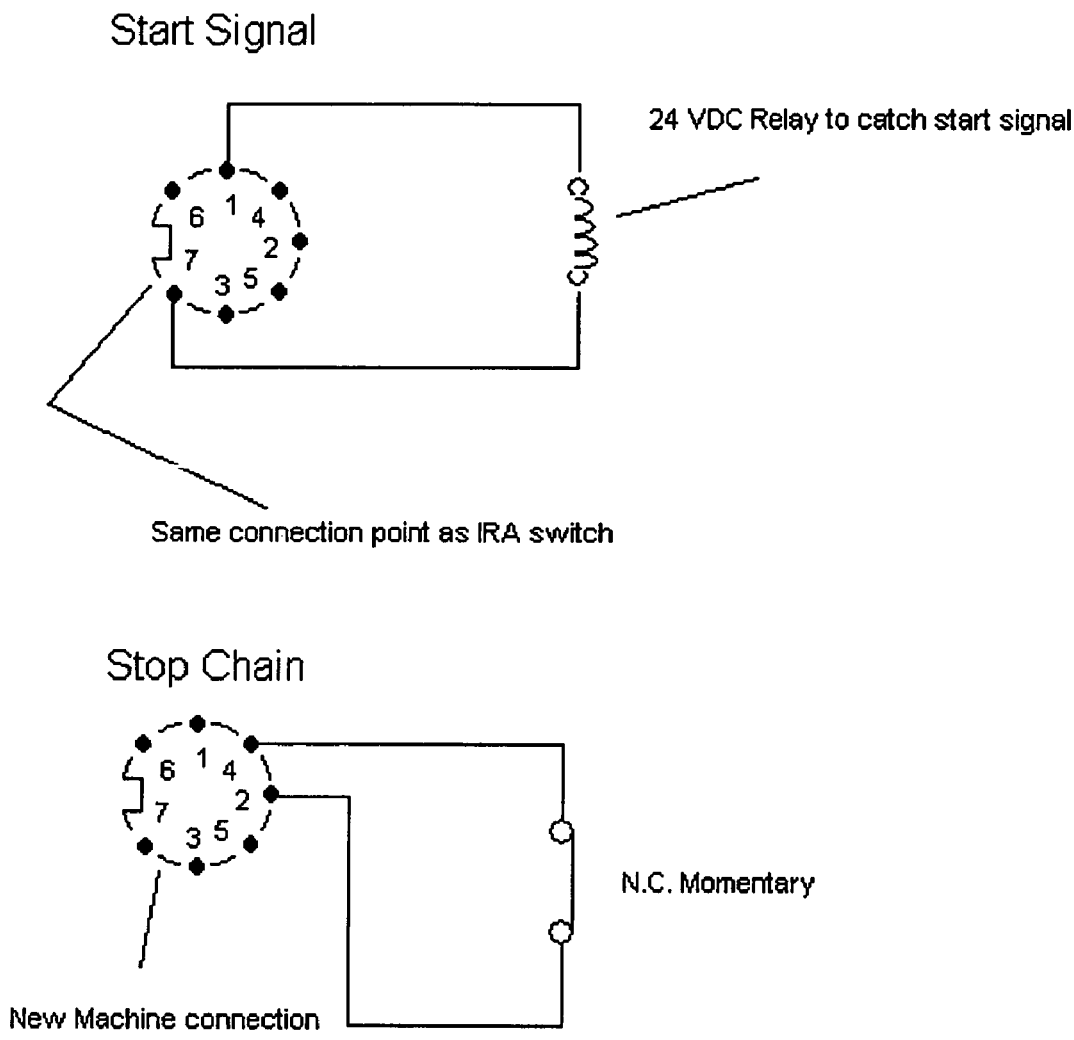
FIG. 3 illustrates the pins of a connection on the screen print machine that transmit operating signals to the print head location.

The PLC 30 interfaces with the screen print machine controller 32 through a pin connection at the work station where the laser is located, in place of a print head. As illustrated in FIG. 3, the screen print machine controller sends a start signal for the print stroke. As illustrated in FIG. 4, the screen print machine controller monitors operational status of the print head by receiving indications from the IRA proximity switch located in the print arm.

FIG. 3 illustrates the pins of a connection on the screen print machine that transmit the start and stop operating signals to the print head location. This pin connection serves as the communication link between the print machine and the PLC. FIG. 4 illustrates the pins of a connection on the screen print machine that receive sensor indications from the IRA switch in the print arm. As illustrated in the time graph of FIG. 5, upon initiation of the start signal from the screen print machine controller, unless the IRA switch remains closed for time between the minimum time of 0.25 seconds and the maximum time of 55 seconds, followed by time period between the minimum time of 0.25 seconds and the maximum time of 55 seconds where the IRA switch is open, the screen print machine controller will detect a fault condition and initiate a stop command to all print head locations on the screen print machine.

Safety Enclosure Door Operation

As shown on FIG. 1, the laser 26 is configured with safety doors 34, which enclose the pallet 18 and supported material portion 16 within the working area of the laser beam, to prevent exposure of extraneous objects to the beam. Safety interlock switches are used to confirm proper positioning of the safety doors before the laser is permitted to operated, and also to insure proper operation of the doors.

To close the door, a door extend command is momentarily applied (approximately 0.5 sec pulse). If a reed switch at the end of door stroke is not activated, a pressure switch on the door is activated, so that if there is a door blockage, the door retract solenoid will activate. When the door is at the end of its travel, the normally open reed switch will close, which will disable the pressure switch. To open the door a door retract signal is momentarily applied (approximately 0.5 sec pulse). As illustrated in FIG. 2, these operating signals, which are normally initiated by the operator, are initiated in the present invention by the PLC upon proper positioning of the each sequential pallet at the work station. The safety interlock switch at the end of door stroke is preferably of the type which uses coded-magnet sensors, such as a Schmersal Inc. Series BNS33 switch. This type of switch is designed for use as a safety interlock switch on movable machine guards/articulating robot arms. The sensor set consists of a multiple reed switch unit and a matching coded-magnet actuator. The reed switches, wired in series, will only close in the presence of their matched magnetic field array, thus, preventing erroneous indications.

PLC Program

Figure 6A:
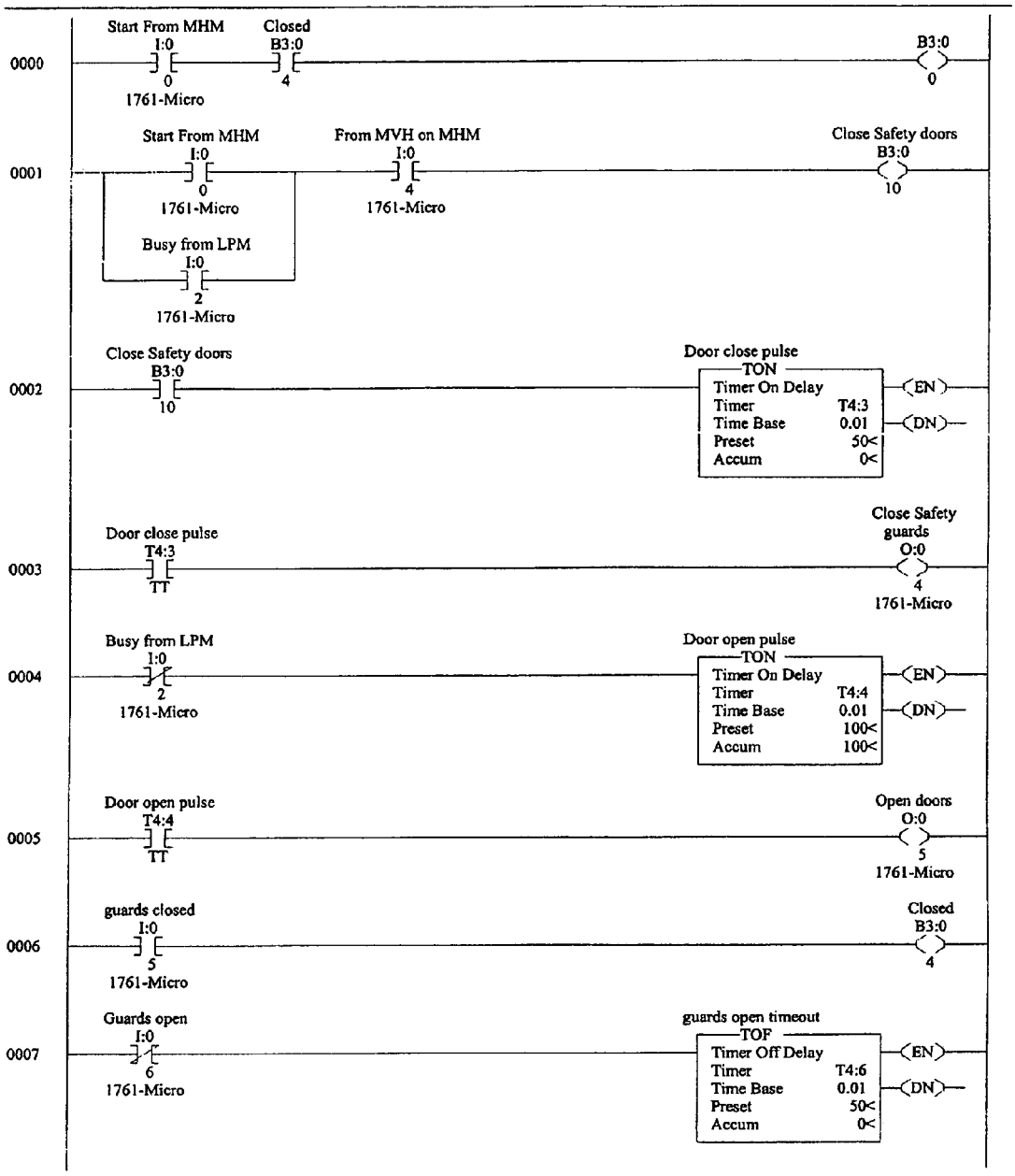
FIGS. 6A, 6B and 6C are illustrations of examples of PLC programming as employed in the present invention.
Figure 6B:
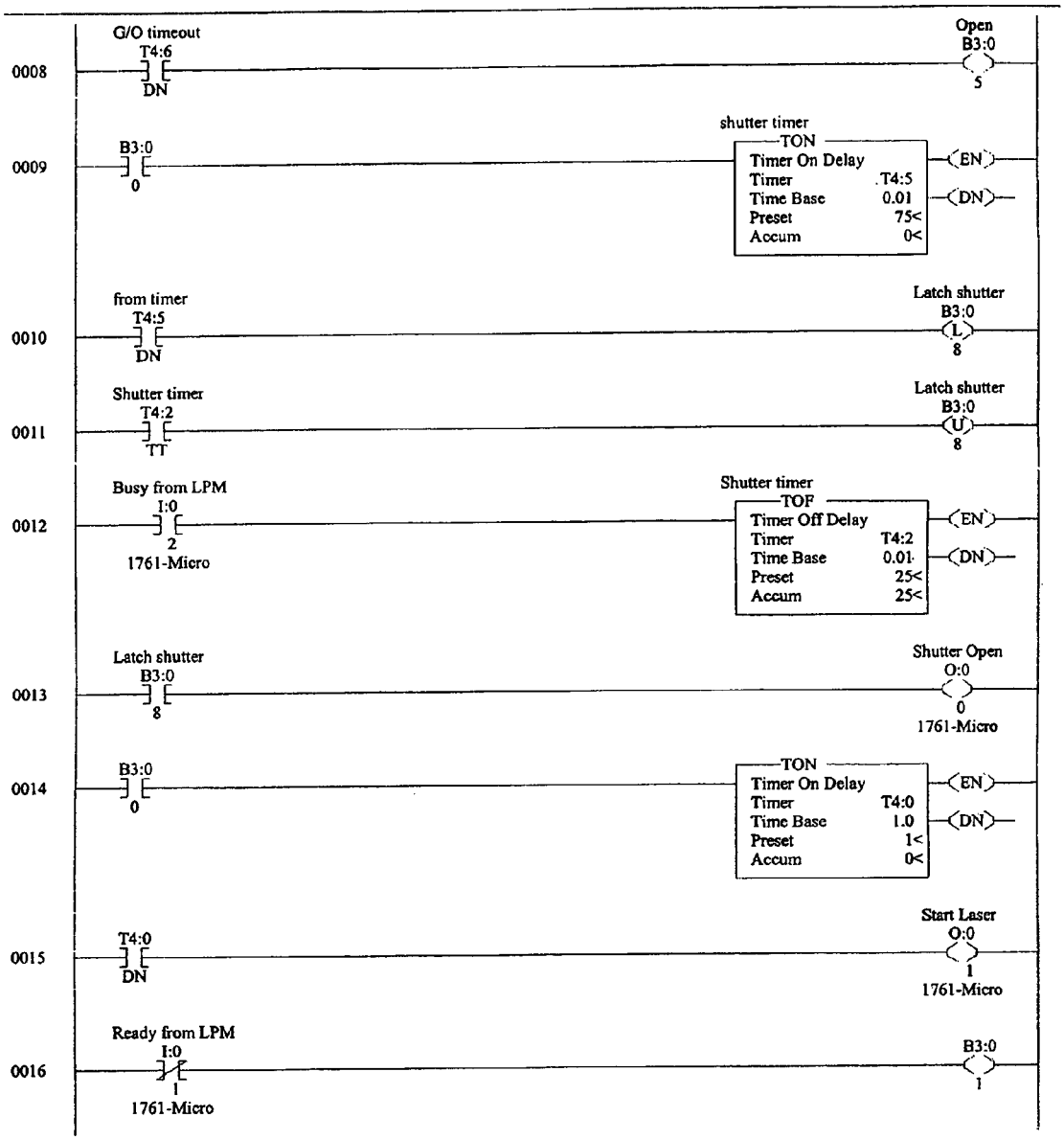
Figure 6C:
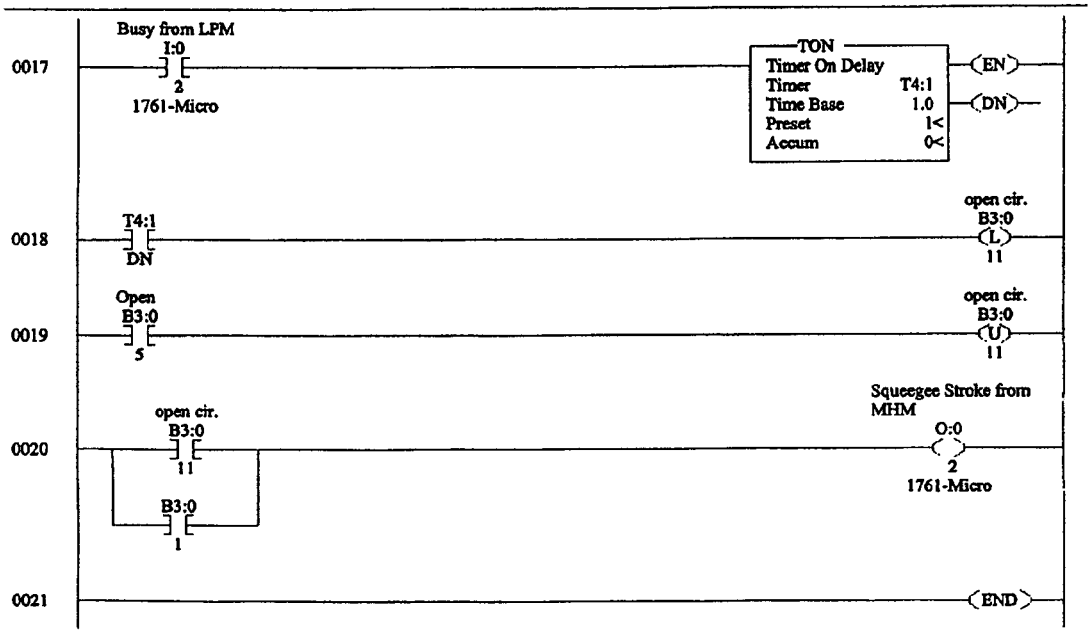

An example of PLC programming as employed in the present invention is illustrated in FIGS. 6A, 6B and 6C. As shown on FIG. 3, between pin 1 and pin 7 the PLC receives an output signal from the screen print machine for the print stroke to start. This corresponds to the command on the PLC program as start from MHM (screen print machine), which is input 0 on rungs 0 and 1 of the PLC ladder logic. As shown on FIG. 4, between pin 4 and pin 3 is a normally closed contact which is the proximity switch that is locate don't eh screen print machine. Opening and closing this switch is accomplished by the PLC. This proximity switch is identified on the PLC program as squeegee stroke from screen print machine ("MHM"). The PLC simulates the indications of a screen print stroke of a print head for the screen print machine controller. For the laser 26 to work, the screen print machine must be programmed to operate the head where the laser is installed. So, if the head where the laser is installed is not programmed to operate in the screen print machine controller, the laser will not function or will not receive a start signal from the screen print machine.

Rung 16 is labeled as ready from the laser control module ("LPM"). The ready signal, which emanates from the laser controller 28 and indicates the laser is prepared to operate, is normally closed. When the PLC is receiving the ready signal, rung 16 is false because input 01 is open, and thus bit 3:01 is not active. On rung 20, bit 3:01 is wrapping around or routing around the open circuit, bit 3:11, simulating or activating the output to module or relay that goes, to the screen print machine. If the laser is not ready, then bit 3:01 is activated, so the circuit wraps around and activates output 2, which simulates the screen print machine loses track of where the squeegee stroke is, or where the squeegee is on the head, which is interpreted on the print machine controller as a fault position, thus preventing the press from operating when the laser is not ready to run.

Once all the operating conditions of the print controller have been met, the system is ready to operate. The laser is turned on, all of its safety interlocks are enabled, all of the safety interlocks on the screen print machine are enabled and head number 7 (or whichever head position to which the laser is connected) is programmed to function, the operator commands the screen print press to rotate and print on the laser station. At that time, the screen print press commands the squeegee on each print head to start. At that time, the PLC receives the start signal from the print head pinout. This causes input 00 of rung 1, which is closed by a start signal from the screen print machine, to be enabled. Also on rung 1, Input 04, which is listed as from MVH on MHM (screen print machine) is the down switch indication from a proximity switch located on the center hub of the screen print machine, signaling that the support arms and print heads of the screen print machine have set down on the pallets at the work stations. This down indication is received by the PLC from the screen print machine controller. Once that requirement is met, input 04 will close as well. Once both of those conditions have been met on rung 1, a signal is sent to close the laser safety doors, bit 3:0 number 10.

On rung 2, once bit 3:0 number 10 is closed, timer T4:3 the door pulse timer, an on-time delay timer, is activated. On line 3, once the door pulse timer is closed, the T4:3 TT timer-timing contact is closed for a second, the safety doors close command, output 4 is sent to the laser control module. Back on rung 0, the first conditional, input 0 start from screen print machine, is already closed, but the door closed conditional, bit 3:04, remains open until a confirmed closed signal on the safety door is received. Once that conditional has also been met on rung 0, bit 3:00 would become energized. Then, on rung 9, because bit 3:0 is closed, it activates the T4:5 on-delay timer of three quarters of a second before opening the laser shutter on rung 10. Once that T4:5 relay has closed, bit 3:08 will activate.

On rung 13, once bit 3:08 has activated, that contact is closed, sending an output signal on output 0 from the PLC to open the shutter on the laser machine.

At the same time that rung 9 receives its closed signal on bit 3:0, on rung 14 bit 3:0 also closes and starts a one-second timer for the laser start signal. Once that one second timing interval has expired, on rung 15, T:40 is energized sending a start signal on output 1, to command the start of laser operation from the PLC. Once the start signal is sent to the laser, the PLC receives a busy signal from the laser.

On rung 1, the drop down input number 2 then closes because of the busy signal from the laser, holding data in the bit for closed safety doors on rung 2. Also, on rung 12, the busy signal from the laser control module would close input 2, activating an off-delay timer that is set for a quarter of a second.

On line 17 another input 2 is satisfied by the busy signal from laser activating an on-timer, timer T4:1. Upon completion of the lasing operation, the busy signal from the laser control module signal terminates. Thus on rung 1, input 2 would open. Also, on rung 12, input 2 would open and the off-delay countdown of a quarter of a second would start on the shutter timer T4:2.

On rung 11, the T4:2 timer timing will unlatch the shutter bit 3:08, allowing the shutter to close. Simultaneously on rung 17, the busy from the laser control module signal terminates and the timer on delay times out one second. On rung 18, T4:1 becomes energized, closing that contact and energizing the open circuit latch, bit 3:011, which opens the safety guard doors.

On rung 7, input 06 is normally closed to a guards open time-out timer, TOF timer T4:6. This is a safety interlock which requires that the laser safety guards must be completely open before giving an indication to the doors that they are open. Once the guards have opened completely, the guards open signal energizes input 06. Then input 06 would open and off-delay timer T4:6 starts timing for half a second. Once that delay has expired, on rung 8, timer T4:6 closes and activates bit 3:05. Once bit 3:05 is active, on rung 19 the conditional is closed, which unlatches the open circuit at bit 3:011 and the process is restarted.

On rung 20, bit 3:011 would be closed and that would unlatch and open that (which if you remember) on the relayed bank that output number 2 is closed, at that time, that relay will go back to its non-powered state which would be a normally closed position and on the SA timing schematic, is when you would get the "circuit is finished" and that is how we are communicating with the SA machine that the squeegee stroke is complete.

On rung 4, input 2 is normally energized, receiving the busy signal from the laser control module. When the busy signal is received, this circuit actually opens, which is in command of the door-open pulse, so once the busy from the laser terminates, the laser operation is finished, and this rung circuit closes again, activating the 1 second Timer On Delay T4:4, and at the end of the 1 second interval giving the door-open post command on rung 5.

In essence, the present invention provides a method of treating portions of material comprising: (1) providing a screen print machine having multiple stations and a turntable with pallets to carry portions from station to station, the machine providing control signals to control the operation of printing heads at each station and machine adapted for receiving status indications from the printing heads to control the operation of the turntable, (2) providing a printing head for screen printing ink on the portions at a first station on the turntable, (3) providing a laser device at a second station on the turntable, the laser providing status signals indicative of the operational status of the laser, and the laser adapted for receiving control indications to control the operation of the laser, (4) connecting a PLC between the laser device and the second station of the screen print machine, the PLC programmed to receive control signals for a printing head at the second station, and to receive status signals from the laser indicative of the operational status of the laser, to send signals based upon the operational status of the laser to the screen print machine, which signals mimic status indications of a printing head located at the second station, and to send control signals to control the operation of the laser in synchronization with the printing head at the first station based upon the received control signals for a printing head at the second station, and (5) processing the material portions on the pallets of the screen print machine.

The present invention also provides an apparatus for treating portions of material comprising: (1) a screen print machine having multiple stations and a turntable with pallets to carry portions from station to station, the machine providing control signals to control the operation of printing heads at each station and machine adapted for receiving status indications from the printing heads to control the operation of the turntable, (2) a printing head for screen printing ink on the portions installed at a first station on the turntable, (3) a laser device installed at a second station on the turntable, the laser providing status signals indicative of the operational status of the laser, and the laser adapted for receiving control indications to control the operation of the laser, and (4) a PLC connected between the laser device and the second station of the screen print machine, the PLC programmed to receive control signals for a printing head at the second station, and to receive status signals from the laser indicative of the operational status of the laser, to send signals based upon the operational status of the laser to the screen print machine, which signals mimic status indications of a printing head located at the second station, and to send control signals to control the operation of the laser in synchronization with the printing head at the first station based upon the received control signals for a printing head at the second station.

While preferred embodiments of the invention and preferred methods of practicing the same have been shown and described herein, persons of ordinary skill in the art will recognize and appreciate that the invention encompasses and includes numerous modifications and variations thereto without departing from the spirit and scope of the present invention. In addition, it should be understood, and persons of ordinary skill in the art will recognize, that aspects of the various preferred embodiments discussed herein may be interchanged or eliminated, both in whole or in part. Furthermore, those of ordinary skill in the art will appreciate the foregoing description is by way of example only, and does not and is not intended to limit the scope, nature and/or variations of the invention.

What is claimed is:

1. A method of treating portions of material comprising:

providing a screen print machine having multiple stations and a turntable with pallets to carry the material portions from station to station, said machine providing control signals to control the operation of printing heads at one or more of the stations, and said machine adapted for receiving status indications from the printing heads to control the operation of the turntable;

providing a printing head for screen printing ink on the material portions at a first station;

providing a laser device at a second station for producing graphics on the material portions on the turntable, the laser device providing status signals indicative of the operational status of the laser device, and said laser device adapted for receiving control indications to control the operation of the laser device;

connecting a PLC between the laser device and the second station of the screen print machine, the PLC programmed to receive control signals from the screen printing machine for a printing head at the second station, and to receive status signals from the laser device indicative of the operational status of the laser device, to send indications based upon the operational status of the laser device to the screen print machine, which indications mimic status indications of a printing head located at the second station, and to send control signals to control the operation of the laser device in synchronization with the printing head at the first station based upon the received control signals for a printing head at the second station; and processing the material portions on the pallets of the screen print machine.

2. The method of claim 1 further comprising:

providing a safety door for the laser device, which door is closable to prevent exposure of extraneous materials to the laser device, and wherein the PLC is programmed to prevent operation of the turntable when the safety door is closed.

3. An apparatus for treating portions of material comprising:

a screen print machine having multiple stations and a turntable with pallets to carry the material portions from station to station, said machine providing control signals to control the operation of printing heads at one or more stations, and said machine adapted for receiving status indications from the printing heads to control the operation of the turntable;

a printing head for screen printing ink on the material portions installed at a first station on the screen print machine;

a laser device installed at a second station for producing graphics on the material portions on the turntable, the laser device providing status signals indicative of the operational status of the laser device, and said laser device adapted for receiving control indications to control the operation of the laser device; and a PLC in communication with the laser device and the second station of the screen print machine, the PLC programmed to receive control signals from the screen printing machine for a printing head at the second station, and to receive status signals from the laser device indicative of the operational status of the laser device, to send indications based upon the operational status of the laser device to the screen print machine, which indications mimic status indications of a printing head located at the second station, and to send control signals to control the operation of the laser device in synchronization with the printing head at the first station based upon the received control signals for a printing head at the second station.

4. The apparatus of claim 3, wherein the laser device includes a safety door which is closable to prevent exposure of extraneous materials to the laser device, and wherein the PLC is programmed to prevent operation of the turntable when the safety door is closed.

* * * * *